US005644822A

United States Patent [19]

Frew

[11] Patent Number: 5,644,822

[45] Date of Patent: Jul. 8, 1997

[54] STRAP BUCKLE

[75] Inventor: Gordon Frew, Indian Rocks Beach, Fla.

[73] Assignee: Net/Werk/USA, Inc., New York, N.Y.

[21] Appl. No.: 625,231

[22] Filed: Apr. 1, 1996

[51] Int. Cl.[6] ..... A44B 11/00

[52] U.S. Cl. ..... 24/196; 24/193; 24/197

[58] Field of Search ..... 24/196, 193, 194, 24/171, 181, 16 R, 197

[56] References Cited

U.S. PATENT DOCUMENTS

| | | | |
|---|---|---|---|
| 1,519,708 | 12/1924 | Tapp et al. | 24/196 |
| 1,836,923 | 12/1931 | Hodge | 24/196 |
| 2,977,655 | 4/1961 | Peters | 24/196 |
| 3,967,347 | 7/1976 | Bickis, Sr. | 24/193 |
| 4,299,014 | 11/1981 | Wood | 24/196 |
| 5,027,479 | 7/1991 | Scheffczyk | 24/196 |
| 5,426,829 | 6/1995 | Hsiung | 24/196 |

FOREIGN PATENT DOCUMENTS

| | | | |
|---|---|---|---|
| 0867048 | 9/1941 | France | 24/197 |

*Primary Examiner*—Victor N. Sakran

*Attorney, Agent, or Firm*—Moonray Kojima

[57] ABSTRACT

A buckle for fastening together the ends of a flat plastic strap, comprising in a unibody construction a pair of parallel ends a pair of parallel side legs disposed between the parallel ends, and a pair of parallel intermediate legs disposed between the parallel side legs with the intermediate legs having a rough top surface and a rough bottom surface, and the side legs have rough bottom surfaces, and constructed in such a manner that one end of the strap is threaded between the two intermediate legs, over the top surface of one intermediate leg and one side leg and under the bottom surface of one side. leg, with the other end of the strap being similarly threaded on the other intermediate leg, whereby the buckle holds tightly the strap after the ends are pulled tightly with the rough surfaces holding the strap and the strap being threaded so as to have four 90° bends at the leg corners to enable better holding by the buckle of the strap in the tightened position.

13 Claims, 2 Drawing Sheets

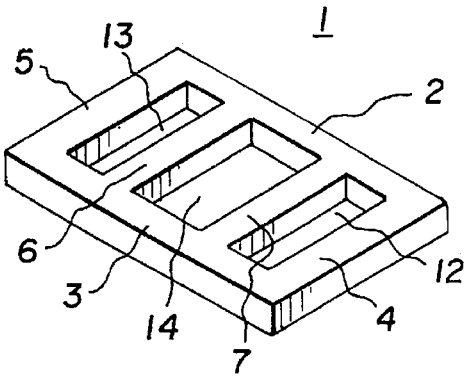
FIG. 1
FIG. 2
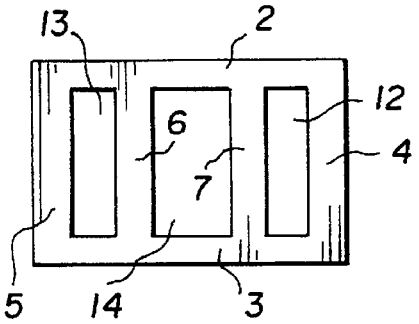
FIG. 3
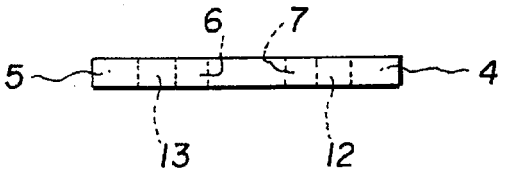
FIG. 4
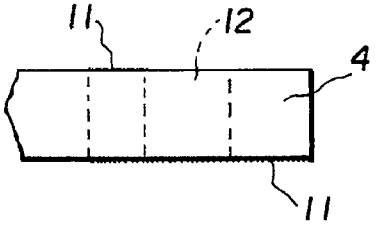
FIG. 5
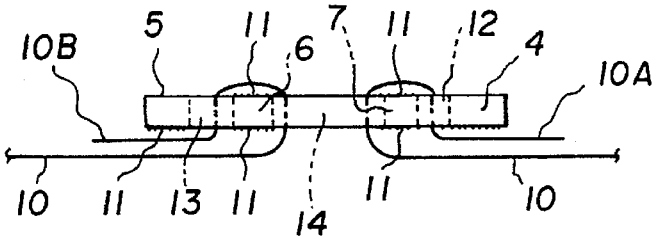
FIG. 6
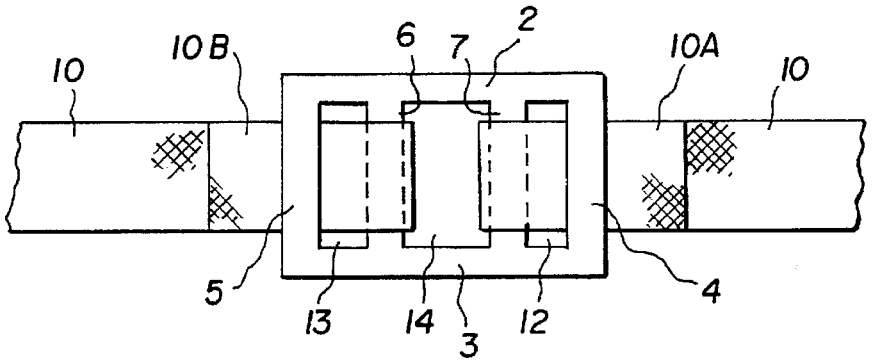

FIG. 7
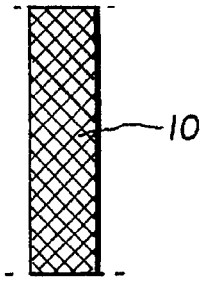
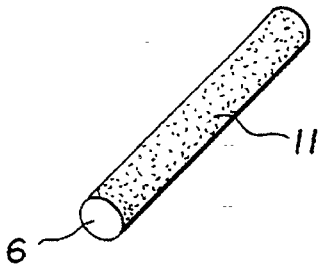
FIG. 8
FIG. 10
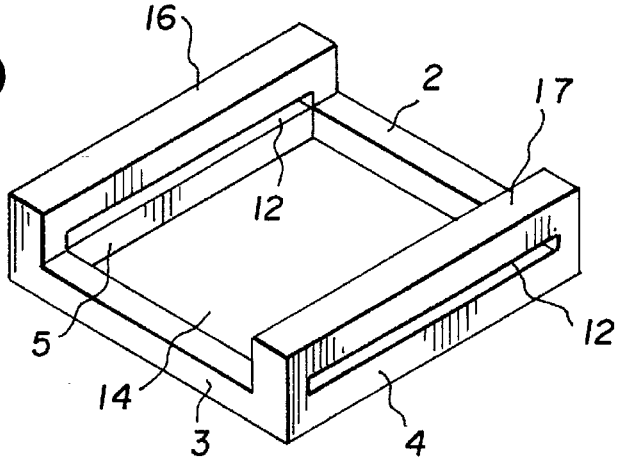
FIG. 9
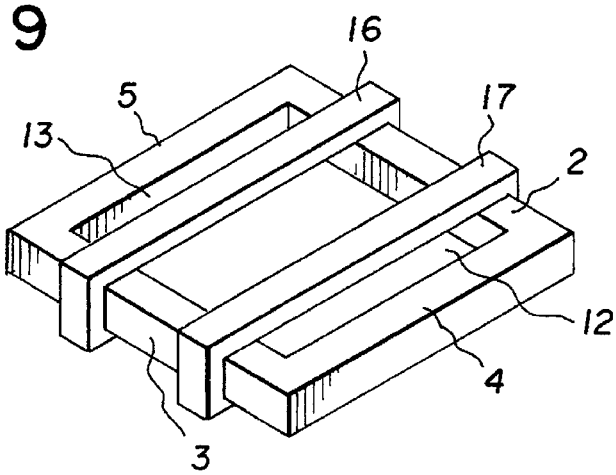

STRAP BUCKLE

BACKGROUND OF THE INVENTION

1. Field of Invention

This invention relates to a buckle for securing the ends of a flat plastic strap; and more particularly, to such buckle which is simple to use in fastening together such strap, and is easy and inexpensive to manufacture.

2. Description of the Prior Art

One conventional strap buckle is made of metal and provides a structure on which the strap is reverse threaded on both ends for securing the strap using a separate large scale tool. Another conventional strap buckle is made of plastic and has a complex connecting fixture through which the strap is reverse threaded at both ends.

These conventional strap buckles are plagued with problems. The metal buckle requires a separate strap tightening tool which is cumbersome and heavy so that a separate fastening station is needed. With the plastic buckle, the threading process is complex and difficult to accomplish.

SUMMARY OF THE INVENTION

An object of the invention is to overcome the aforementioned and other deficiencies and disadvantages of the prior art.

The foregoing and other objects are attained by the invention which encompasses a buckle for fastening together the ends of a flat plastic strap comprising a unibody plastic structure having a pair of parallel ends connected to a pair of parallel side legs with a pair of intermediate legs disposed and connected parallel between the parallel side legs to the ends. The bottom surfaces of the various legs and ends and the top surfaces of the legs and ends are generally in parallel planes, with the bottom surfaces of the side legs and the intermediate legs and the upper surface of the intermediate legs having a rough surface, and the intermediate legs and side legs being located with respect to each other such that the spaces formed therebetween are suitable for passage of the strap, whereby the strap is threaded with one end portion passing between the two intermediate legs, over the upper surface of one intermediate leg, and between the one intermediate leg and one side leg, and then under the bottom surface of the one side leg and above the remainder of the strap, with the other end portion of the strap being similarly threaded through the other intermediate leg and other side leg. By pulling the end portion, the strap is tightened with the buckle, with the rough surfaces of the intermediate leg and side leg also assisting in holding the strap securely. Advantageously, with this arrangement, each end portion of the strap is threaded to be bent four times at right angles (90°) so that after tightening, the buckle with the four right angled bends makes possible locking and better tightening of the strap. Advantageously, the buckle can be easily and inexpensively made, such as by use of plastic molding, plastic stamping, and plastic extruding.

In one use of the buckle, one end portion of the strap may be threaded and permanently bonded to part of the strap through the buckle so that one end portion of the strap is free and the other end has a permanent buckle attached thereto, so that a customer need only place the strap around a box, for example, and then thread the free end of the strap through the buckle, then pull to tighten the strap around the box. This would be simpler than a rope, for example, which requires a knot.

BRIEF DESCRIPTION OF THE DRAWINGS

FIG. 1 a perspective view depicting an illustrative embodiment of the invention.

FIG. 2 is a plan view of the embodiment of FIG. 1.

FIG. 3 is a side view of the embodiment of FIG. 1.

FIG. 4 is a partial enlarged side view depicting the rough surfaces of one intermediate leg and one side leg.

FIG. 5 is a partial side view depicting the strap being threaded through.

FIG. 6 is a pictorial plan view depicting the embodiment having a strap threaded therethrough.

FIG. 7 is a plan view of the strap which is fastened by the buckle of the invention.

FIG. 8 is a perspective view depicting an alternative intermediate leg and showing a rough surface thereof.

FIG. 9 and 10 are perspective views depicting two further illustrative embodiments showing a different intermediate leg arrangement, wherein the intermediate legs are arranged above the top surface of the side legs and ends.

DETAILED DESCRIPTION OF THE PREFERRED EMBODIMENTS

FIGS. 1, 2, 3, 4, 5 and 6 show a unibody plastic construction of an illustrative strap buckle 1, comprising a pair of end legs 2, 3 between which are connected a pair of side legs 4, 5 and disposed therebetween a pair of intermediate legs 6, 7 which are also connected to the end legs 2, 3. Between intermediate legs 6, 7 and side legs 4, 5, respectively, are spades 12, 13 of suitable dimensions so that the thickness of the strap 10 (see FIGS. 5, 6, 7) will fit therethrough. Between intermediate legs 6, 7 is space 14. The top and bottom surfaces thereof are roughened (see rough surfaces 11 in FIG. 4) The intermediate legs 6, 7 have the top and bottom surfaces thereof roughened. (see FIGS. 4, and 5). Other surfaces, such as of the vertical side surfaces of intermediate legs 6, 7 and vertical side surface adjacent space 12, 13 of side legs 4, 5 may also be made rough. The roughened surfaces provide frictional force to hold the strap when such strap is disposed adjacent the roughened surface.

FIG. 7 shows a plastic strap 10 which has striations on both flat surfaces thereof (note only one surface is shown, but, both surfaces are made rough with striation patterns thereon). The rectangular patterns can be other geometric patterns and would serve the same purpose. The raised patterns are useful in enabling the buckle to hold the strap in the tightened condition.

The threading and tightening of the strap 10 using buckle 1 is now explained with reference to FIGS. 5 and 6. The ends 10A, 10B of strap 10 are threaded through the buckle in the following manner, taking end 10A as an example, with end 10B being likewise threaded. End 10A is first threaded under rough surface 11 at the bottom thereof of intermediate leg 7, then threaded upward through space 14 between intermediate legs 6, 7, then threaded over rough top surface 11 of intermediate leg 7, then through space 12 between intermediate leg 7 and side leg 4, and then under rough surface 11 of side leg 4, and then, suitably tightened by pulling on end 10A, and then end 10A is cut to size by use of a scissor. The other end 10B is likewise threaded through the other end of buckle 1 and cut to size. Advantageously, as can be seen in FIG. 5, the threaded end is bent or turned four times, each at right angle (90°) so that each bent 90° angle helps to lock the strap 10 in a tightened position. Use of three 90° bends would also be operable.

Also, an end portion 10A or 10B can just as easily be first threaded and then permanently bonded or glued so that a precut strap having a permanent buckle on end end thereof can be produced. In this manner, a customer can, similar to a garment belt, purchase a pre-buckled strap, and place the strap around a box, for example, and then thread the free end of the strap through the unthreaded end of the buckle, and then pull the free end of the strap, and then cut to size.

After tightening, the strap will be locked and substantially tightened by the holding effect of the rough surface 11 and the four 90° bends in the strap at the leg parts of the buckle.

Thus, advantageously, the arrangement can be an inexpensive, and simple substitute for a rope, for example, with the added advantage that the rope being round always cuts into the surface being bound, whereas the invention uses a flat strap wherein the tightening pressure is more evenly distributed and no concentration of force causes the bound surface to become cut by the strap. Also, advantageously, the invention is simple to thread and use. Moreover, the foregoing advantages are compounded by the arrangement being inexpensive to produce.

As mentioned, the buckle of the invention can be made of platic material or the like, and hence,can be readily produced by molding, stamping or extruding. Thus, the material is inexpensive,. and so is the method of manufacture.

FIG. 8 shows an alternative shape for the intermediate legs 6, 7, that is the intermediate legs instead of being rectangular in shape, can be circular and also have rough surfaces 11.

Other further illustrative embodiments are shown in FIGS. 9 and 10 which differ from the embodiment of FIGS. 1–6 in that the intermediate legs 6 and 7 of FIGS. 1–6 have the bottom and top surfaces generally and substantially on the same bottom and top surface planes of the remaining structure, whereas in FIGS. 9, 10, the intermediate legs 16 and 17 are formed so that the bottom surfaces thereof are generally and substantially in the neighborhood of the top surface of the remaining structures 2, 3, 4 and 5, and the top surface of the intermediate legs 16, 17 are above the top surfaces of the remaining structures 2, 3, 4, 5. Legs 16 and 17 may be formed integrally with the remaining parts 2, 3, 4, 5, or may be formed separately, in which latter case, the intermediate parts 16, 17 will have ends which can be moved and snap fitted to the end parts 2 and 3 as shown. Spaces 12 and 14 are as shown.

The foregoing description is illustrative of the principles of the invention. Numerous extensions and modifications thereof would be apparent to the worker skilled in the art. All such extensions and modifications are to be considered to be within the spirit and scope of the invention.

What is claimed is:

1. A buckle for fastening ends of a flat strap, said buckle consisting of a unitary structure consisting of:

a pair of parallel end portions;

a pair of parallel side legs each having two ends disposed between and directly connected permanently and perpendicularly at said two ends to said pair of end portions; and a pair of parallel intermediate legs each having two ends and of generally rectangular cross-section immovably disposed between and directly connected permanently and perpendicularly at said two ends to said pair of end portions and parallel to said side legs with a predetermined space between each intermediate leg and each side leg, so that an end of said flat strap is threaded under a bottom surface of one intermediate leg, between said pair of intermediate legs, over a top surface of said one intermediate leg, between said one intermediate leg and one side leg, and below a bottom surface of said one side leg and above a part of said flat strap, whereby said threaded strap is bent at least three times at substantially right angles so that upon pulling of said flat strap to tighten, said flat strap is held in substantially the tightened position.

2. The buckle of claim 1, wherein said end portions, said side legs, and said intermediate legs have common bottom surfaces and common top surfaces.

3. The buckle of claim 1, wherein said intermediate legs are positioned to have bottom surfaces thereof disposed generally above bottom surfaces of said side legs and said end portions.

4. The buckle of claim 1, wherein said end portions, said intermediate legs, and said side legs are made of plastic.

5. The buckle of claim 4, wherein said end portions, said intermediate legs, and said side legs are formed by molding, stamping or extrusion.

6. The buckle of claim 1, wherein said threaded strap is bent four times at right angles.

7. The buckle of claim 1, wherein said end portions, said side legs, and said intermediate legs do not have common bottom surfaces and do not have common top surfaces.

8. The buckle of claim 7, wherein said intermediate legs are disposed to be on top of said side legs with said space being therebetween.

9. A buckle for fastening ends of a flat strap, said buckle consisting of a unitary structure consisting of:

a pair of parallel end portions;

a pair of parallel side legs each having two ends disposed between and directly connected permanently at said two ends to said pair of parallel end portions;

a pair of parallel intermediate legs each having two ends and of generally rectangular cross-section immovably disposed between and directly connected permanently and perpendicularly at said two ends to said pair of parallel end portions and parallel to said pair of parallel side legs with a predetermined space between each intermediate leg and each side leg; and wherein one end of said flat strap is threaded under a bottom surface of one intermediate leg, between said pair of intermediate legs, over a top surface of said one intermediate leg, between said one intermediate leg and one side leg, and below a bottom surface of said one side leg, and having said one end of said strap permanently attached to said strap after being threaded; and wherein the other end of said flat strap is unattached so that said other end can be bound about an object to be tied and said other end can be similarly threaded under a bottom surface of the other intermediate leg, between said pair of intermediate legs, over a top surface of said other intermediate leg, between said other intermediate leg and the other side leg, and below a bottom surface of said other side leg and above a part of said flat strap, whereby said unattached end is threaded so that said strap is bent at least three times at substantially right angles so that upon pulling to tighten, the strap is held in sustantially tightened position.

10. The buckle of claim 9, wherein said strap is bent four times at right angles.

11. The buckle of claim 9, wherein said end portions, said side legs, and said intermediate legs have common bottom surfaces and common top surfaces.

12. The buckle of claim 9, wherein said end portions, said side legs, and said intermediate legs do not have common bottom surfaces and do not have common top surfaces.

13. The buckle of claim 9, wherein said intermediate legs are disposed to be on top of said side legs with said space being therebetween.

* * * * *